United States Patent [19]

Nielsen

[11] Patent Number: 4,736,488

[45] Date of Patent: Apr. 12, 1988

[54] PAINT DRIP PAN

[76] Inventor: Ruth A. Nielsen, P.O. Box 507, Cibolo, Tex. 78108

[21] Appl. No.: 921,544

[22] Filed: Oct. 22, 1986

[51] Int. Cl.[4] ..... B05C 21/00; A41D 13/08

[52] U.S. Cl. ..... 15/257 R; 2/16; 2/160; 15/248 R; 51/272; 118/504; 220/DIG. 5; 294/131; 312/1; 401/15

[58] Field of Search ..... 15/248 R, 248 A, 257 R; 2/16, 160, DIG. 7, 2; 220/DIG. 5; 312/1; 408/67; 294/131; 401/15; 118/504; 51/272

[56] References Cited

U.S. PATENT DOCUMENTS

| | | | |
|---|---|---|---|
| D. 286,459 | 10/1986 | Nielsen | D32/53.1 |
| 41,060 | 1/1864 | Davis . | |
| 292,247 | 1/1884 | Millett | 118/504 |
| 939,902 | 11/1909 | Garrison | 24/170 |
| 1,534,208 | 4/1925 | Gibson | 239/288 |
| 2,497,749 | 2/1950 | Wagner | 2/16 |
| 2,574,042 | 11/1951 | Kunau | 15/248 R |
| 2,812,784 | 11/1957 | Palmer | 141/98 |
| 3,086,674 | 4/1963 | Scheuerman | 312/1 X |
| 3,395,957 | 8/1968 | Peele | 312/1 |
| 3,415,582 | 12/1968 | Trexler | 312/1 |
| 3,570,009 | 3/1971 | Spruell | 2/16 |
| 3,806,952 | 4/1974 | Viciulis | 2/16 |
| 3,858,418 | 1/1975 | Butler | 312/1 X |
| 4,031,589 | 6/1977 | Couch | 15/248 R |
| 4,214,317 | 7/1980 | Kelly | 2/16 X |
| 4,325,159 | 4/1982 | Rico | 15/248 AX |
| 4,578,823 | 4/1986 | Hudson | 2/16 |

FOREIGN PATENT DOCUMENTS

| | | | |
|---|---|---|---|
| 138090 | 1/1903 | Fed. Rep. of Germany | 118/504 |

OTHER PUBLICATIONS

Candle Wax Shield (attached hereto) for Removable Attachment to a Candle by Inserting the Candle Through the Hole in the Shield.

"Henry", comic strip from Washington Post of Jan 8, 1959.

*Primary Examiner*—Chris K. Moore

*Attorney, Agent, or Firm*—Richard J. Smith

[57] ABSTRACT

A paint drip pan and method for constructing same. A base member has an aperture therethrough within which to receive a painter's wrist. A glove member may be located within the aperture and secured to the base member. A plurality of fingers integral with the base member are adapted to impinge against the glove member to secure the base member to the painter's wrist.

12 Claims, 6 Drawing Sheets

PAINT DRIP PAN

BACKGROUND OF THE INVENTION

The present invention relates to a drip pan for catching paint drips or splatters during painting operations.

A problem which arises when painting is done overhead or along the intersection of a ceiling and side wall is the dripping or splattering of paint onto the painter or painter's clothing. Prior efforts to address the paint drip problem are shown in U.S. Pat. Nos. 4,031,589, 2,574,042 and 41,060. U.S. Pat. No. 4,031,589 discloses a portable drip collector. U.S. Pat. No. 2,574,042 discloses a drip collecting attachment for paint brushes. U.S. Pat. No. 41,060 discloses a drip receiving brush socket. Nevertheless, none of the aforementioned references teach or suggest a self adjusting, self supporting, self grasping paint drip pan which is adapted to grip a painter's wrist.

SUMMARY OF THE INVENTION

Accordingly, the present invention provides a self adjusting, self supporting, self grasping paint drip pan comprising a base member having an aperture therethrough within which to receive a painter's wrist. The aperture is cut in the base member so as to provide a plurality of fingers adapted to grip the painter's wrist or lower arm. A glove member may be located within the aperture and secured to the base member. When the paint drip pan of the present invention is in use, dripping and splattering paint will be caught by the pan, thereby shielding the painter and painter's clothing. The present invention also provides a method for constructing a paint drip pan comprising the steps of cutting slits in a base member to form an aperture and gripping fingers and inserting a glove member through the aperture. The glove member may thereafter be secured to the base member.

DETAILED DESCRIPTION OF THE PREFERRED EMBODIMENT

Figure 3:
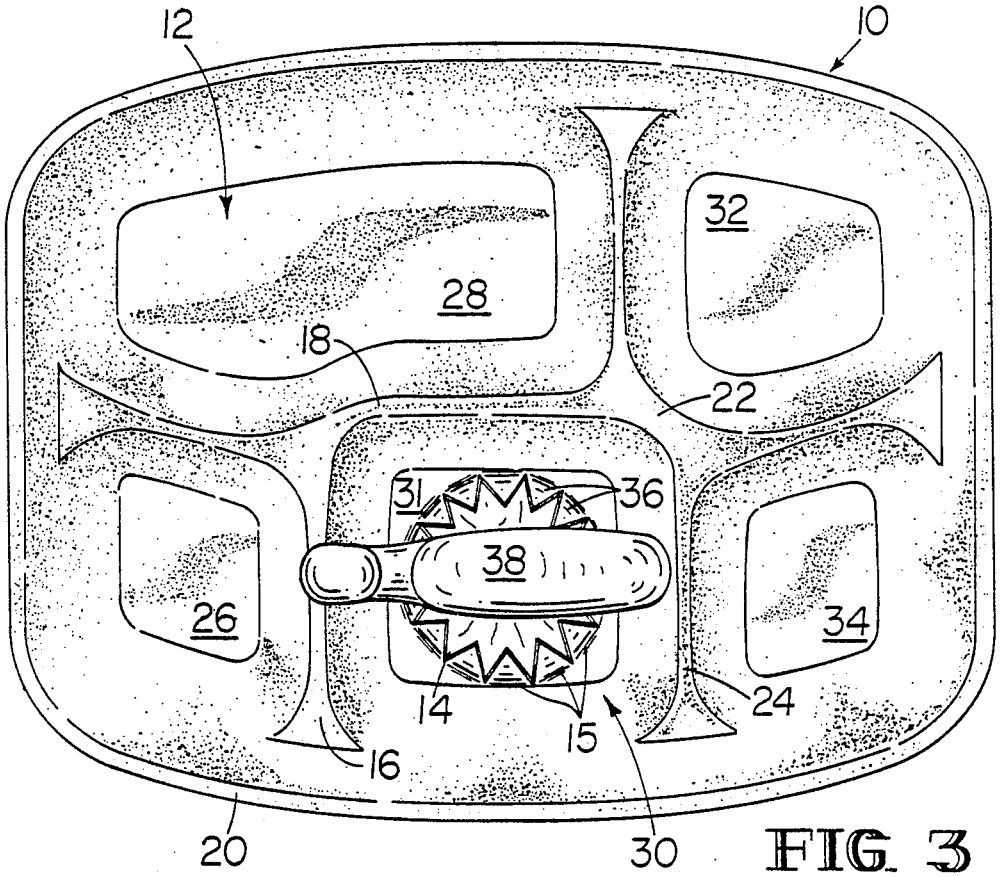
FIG. 3 is a top view of the preferred embodiment of a paint drip pan.
Figure 1:
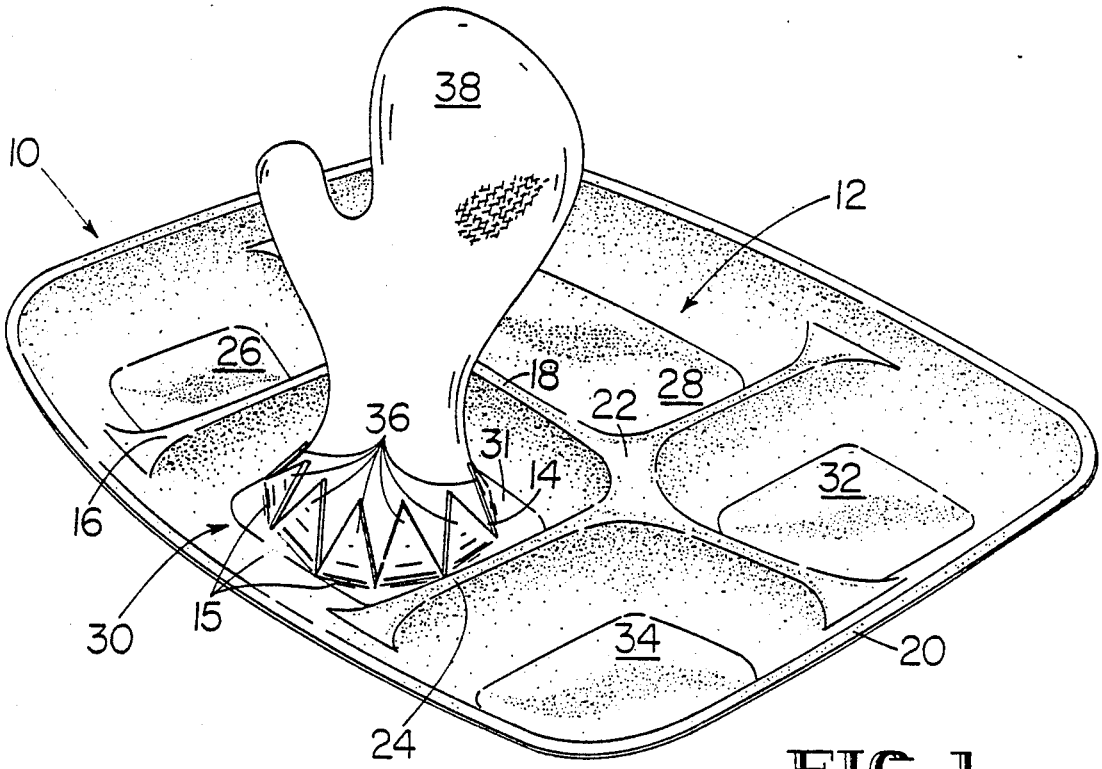
FIG. 1 is a perspective view of the top of the preferred embodiment of a paint drip pan.
Figure 2:
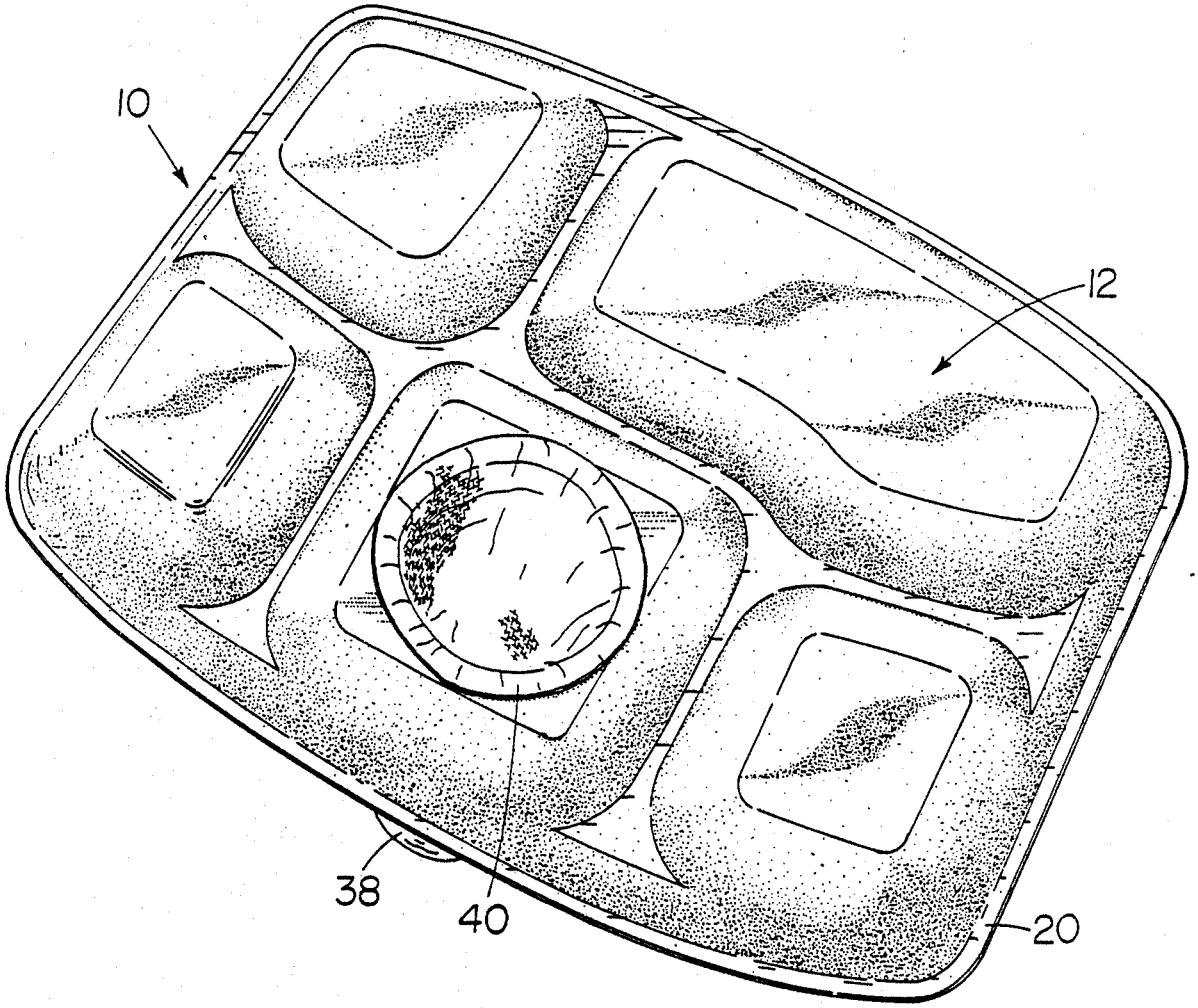
FIG. 2 is a perspective view of the bottom of the preferred embodiment of a paint drip pan.

Referring to FIGS. 1-3, the paint drip pan of the present invention is identified by the number 10. The paint drip pan 10 comprises a substantially rectangular base member 12 which is preferably constructed of cardboard or styrofoam. The base member 12 shown in FIGS. 1-3 is a conventional, integral styrofoam food tray which has been modified as described hereinbelow. The base member 12 has an aperture 14 therethrough. Aperture 14 is appropriately sized and shaped to receive a painter's hand and wrist. As further illustrated in FIG. 1 and FIG. 3, the uppermost surface of the base member 12 is provided with a plurality of integral ridges 16, 18, 22, and 24. The perimeter of base member 12 comprises a lip or flange 20. Lip 20 and ridges 16, 18, 22, and 24 define a plurality of distinct compartments or channels 26, 28, 30, 32, and 34. Compartments 26, 28, 32, and 34 are separated from compartment 30 by ridges 16, 18, 22, and 24, respectively. Each compartment 26, 28, 30, 32, and 34 has a floor and a plurality of side walls.

Referring to FIG. 1 and FIG. 3, aperture 14 is formed by making a plurality of cuts or slits in the floor 31 of compartment 30 so as to define or form a plurality of resilient, pointed fingers or teeth 36 integral with base member 12 about aperture 14. As illustrated in FIG. 1 and FIG. 2, a flexible, nonporous glove member 38, such as a plastic mitten or bag, is preferably located within aperture 14 and connected to base member 12 by gluing or otherwise securing the lowermost edge 40 of glove member 38 to the underside of base member 12. When the glove member 38 is secured within aperture 14, fingers 36 are folded or bent upward along fold line 15 about aperture 14, as illustrated in FIG. 1 and FIG. 3, in a manner so as to be inwardly and downwardly biased toward approximately the center of aperture 14, thereby gripping or impinging against the wrist portion or lowermost end of glove member 38.

During usage of the paint drip pan 10, a painter's hand is inserted through aperture 14 from the underside of base member 12 into the glove member 38, with the hand covered by glove member 38 thereafter gripping the paint brush or roller (not shown). When the painter's hand is inserted through aperture 14, fingers 36 will expand to accommodate the size of the painter's hand and wrist. During painting operations, any dripping or splattering of the paint from the brush or roller will contact glove member 38 and/or be received within distinct channels 26, 28, 30, 32, or 34, with lip 20 and ridges 16, 18, 22, and 24 impeding runoff of paint. The wristlet defined by aperture 14 and fingers 36 keeps the pan 10 secured to the painter's wrist while allowing the painter's hands to be free for work. The wristlet defined by aperture 14 and fingers 36 also allows the base member 12 to be turned or tilted in a desired direction. During painting operations, the paint drip pan 10 remains secured to the painter, with base member 12 substantially transverse to the painter's lower arm, by means of the resilient fingers 36 which impinge against glove 38 and grip the painter's wrist.

Referring to FIGS. 4-8, an alternate embodiment of the paint drip pan of the present invention is identified by the number 11, with like numbers being utilized to identify features discussed hereinabove. The paint drip pan 11 comprises an integral base member 13 which is preferably constructed of cardboard or styrofoam. The base member 13 has an aperture 14 therethrough. Aperture 14 is appropriately sized and shaped to receive a painter's hand and wrist. As further illustrated in FIG. 4 and FIG. 6, the uppermost surface of the base member 13 is provided with a plurality of ridges 17, 19, 23, and 25. Ridges 17, 19, 23, and 25 define a plurality of distinct compartments or channels 27, 29, 33, and 37, respectively, which encompass aperture 14. The perimeter of base member 13 comprises a lip or flange 21. Each channel 27, 29, 33, and 37 has a floor and a plurality of side walls.

Figure 4:
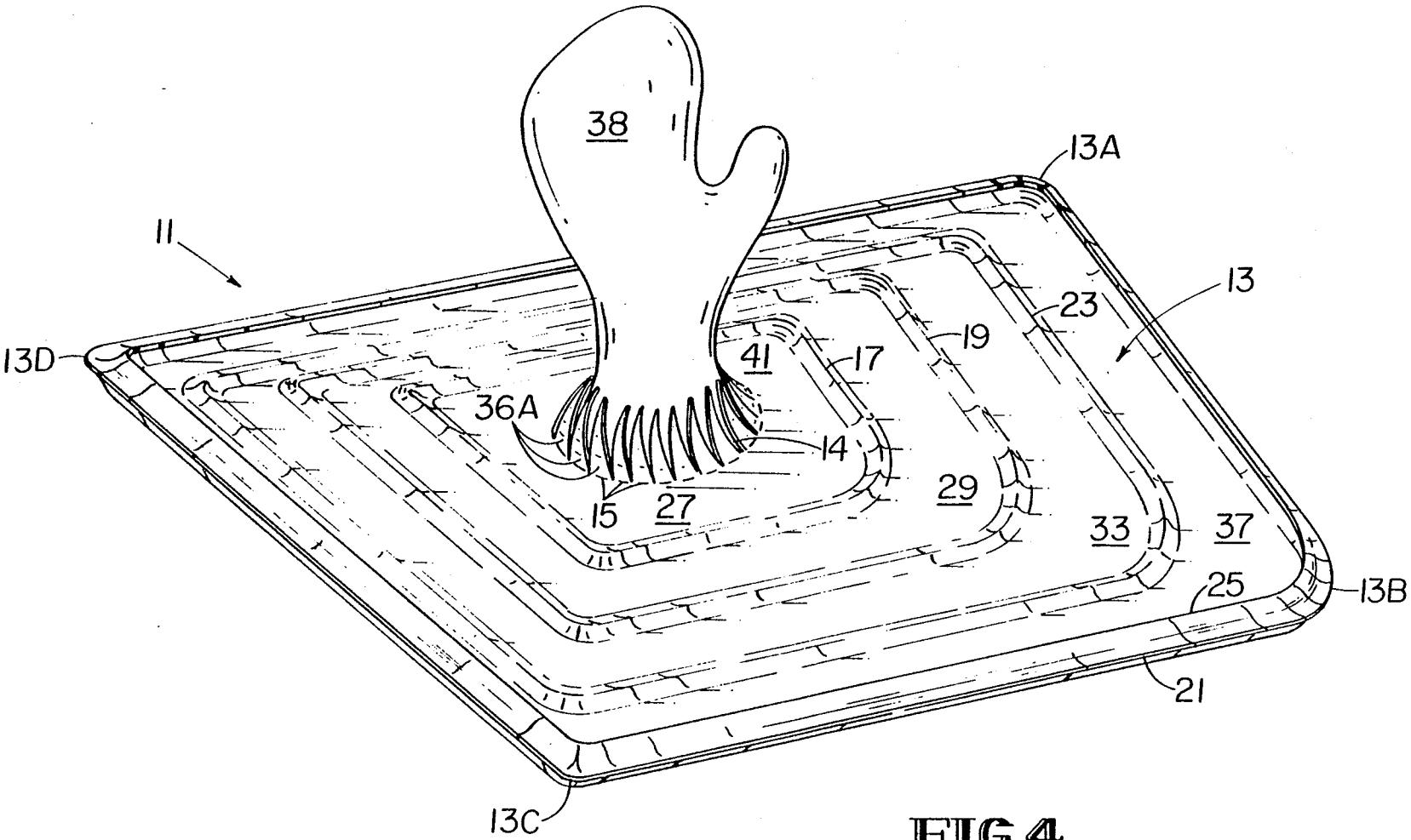
FIG. 4 is a perspective view of the top of an alternate embodiment of a paint drip pan.
Figure 5:
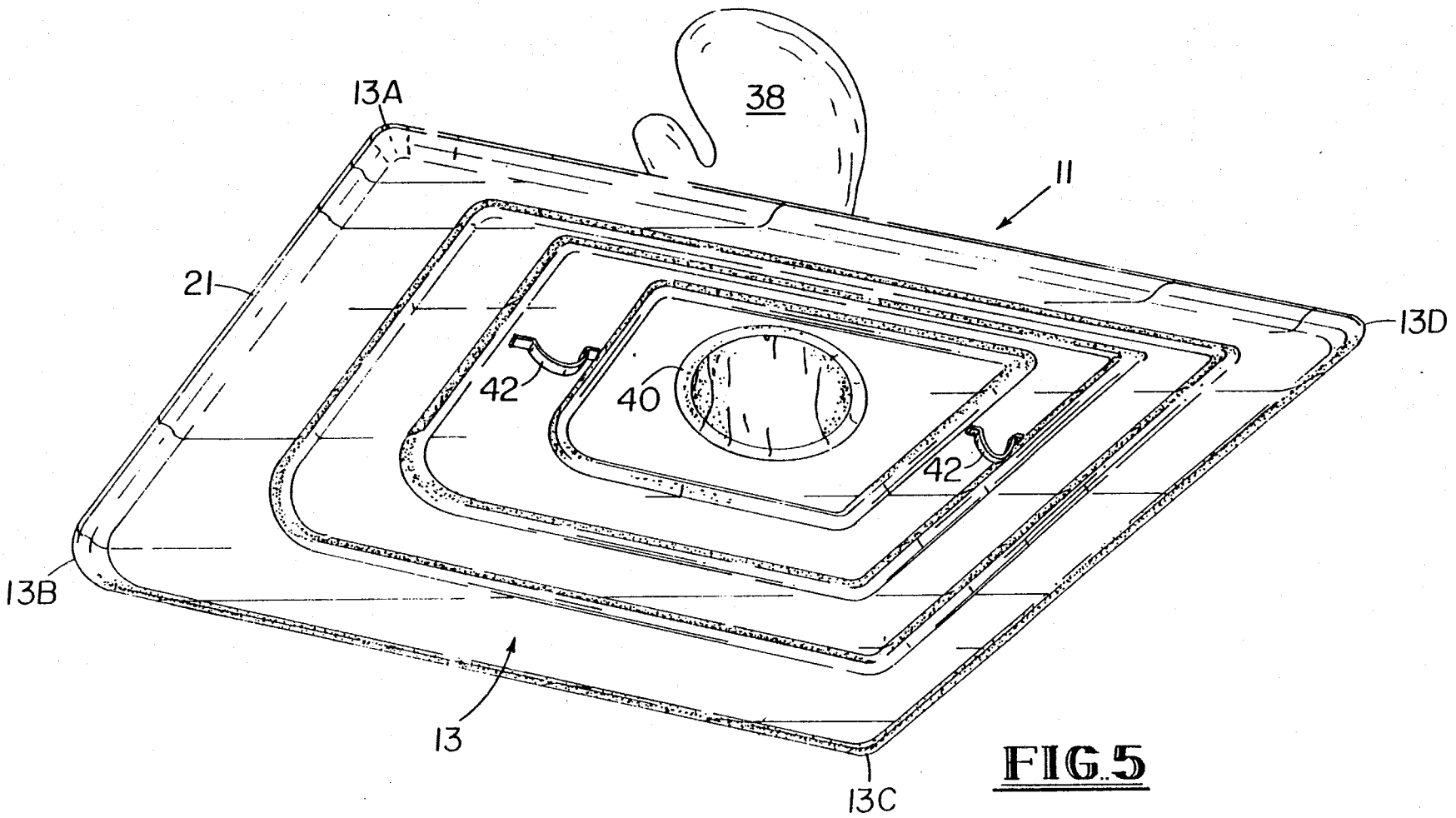
FIG. 5 is a perspective view of the bottom of an alternate embodiment of a paint drip pan.
Figure 7:
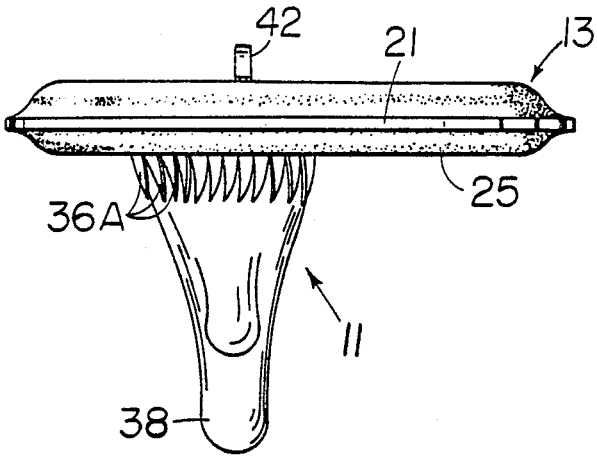
FIG. 7 is a side view of an alternate embodiment of a paint drip pan.
Figure 6:
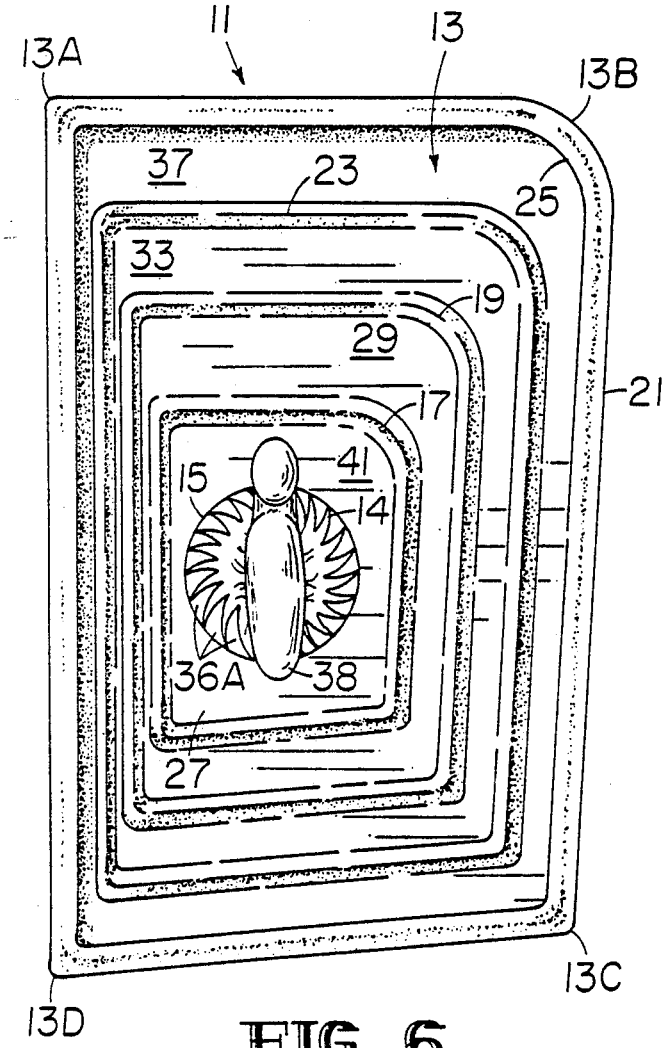
FIG. 6 is a top view of an alternate embodiment of a paint drip pan.

As further illustrated in FIGS. 4–6, the base member 13 may be appropriately shaped to facilitate usage of the pan 11 in a corner. The respective edges of base member 13 which intersect at corner 13A define or form approximately a right angle with respect to each other. The respective edges of base member 13 which intersect at corner 13B form a substantially curved corner 13B. The respective edges of base member 13 which intersect at corner 13C define or form approximately an obtuse angle with respect to each other. The respective edges of base member 13 which intersect at corner 13D define or form approxiamtley an acute angle with respect to each other.

Referring to FIG. 4 and FIG. 6, aperture 14 is formed by making a plurality of cuts or slits in the floor 41 of channel 27 so as to define or form a plurality of resilient, pointed fingers or teeth 36A integral with base member 13 about aperture 14. As illustrated in FIG. 4 and FIG. 5, a flexible, nonporous glove member 38, such as a plastic mitten or bag, is preferably located within aperture 14 and connected to base member 13 by gluing or otherwise securing the lowermost edge 40 of glove member 3 to the underside of base member 13. When the glove member 38 is secured within aperture 14, fingers 36A are folded or bent upward along fold line 15 about aperture 14, as illustrated in FIG. 4 and FIG. 6, in a manner so as to be inwardly and downwardly biased toward approximately the center of aperture 14, thereby gripping or impinging against the wrist portion or lowermost end of glove member 38.

During usage of the paint drip pan 11, a painter's hand is inserted through aperture 14 from the underside of base member 13 into the glove member 38, with the hand covered by glove member 38 thereafter gripping the paint brush or roller (not shown). When the painter's hand is inserted through aperture 14, fingers 36A will expand to accommodate the size of the painter's hand and wrist. During painting operations, any dripping or splattering of the paint from the brush or roller will contact glove member 38 and/or be received within distinct channels 27, 29, 33, or 37, with ridges 17, 19, 23, and 25 impeding runoff of paint. The wristlet defined by aperture 14 and fingers 36A keeps the pan 11 secured to the painter's wrist while allowing the painter's hands to be free for work.

Figure 8:
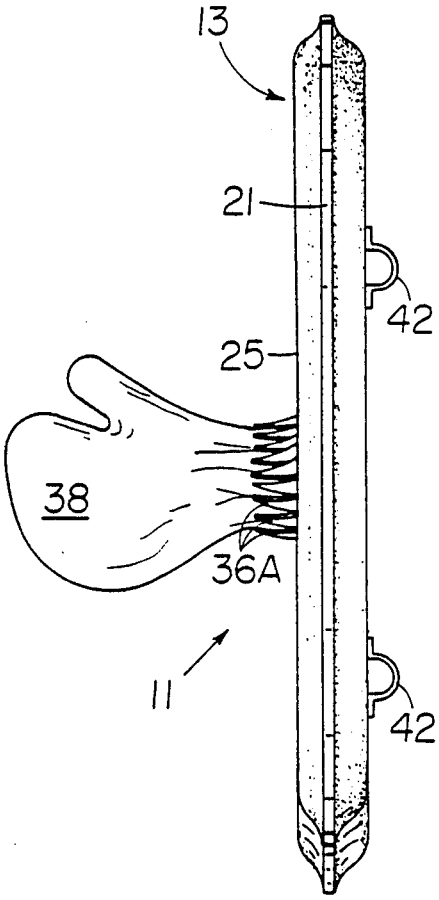
FIG. 8 is another side view of an alternate embodiment of a paint drip pan.

During painting operations, the paint drip pan 11 remains secured to the painter, with base member 13 substantially transverse to the painter's lower arm, by means of the resilient fingers 36A which impinge against glove 38 and grip the painter's wrist. The wristlet defined by aperture 14 and fingers 36A also allows the base member 13 to be turned or tilted in a desired direction. As illustrated in FIG. 5 and FIG. 8, the paint drip pan 11 is also preferably provided with a pair of guide loops 42 which are glued or otherwise appropriately secured to the underside of base member 13 and may be utilized by the painter's other hand to tilt the base member 13 in the desired direction.

Figure 9A:
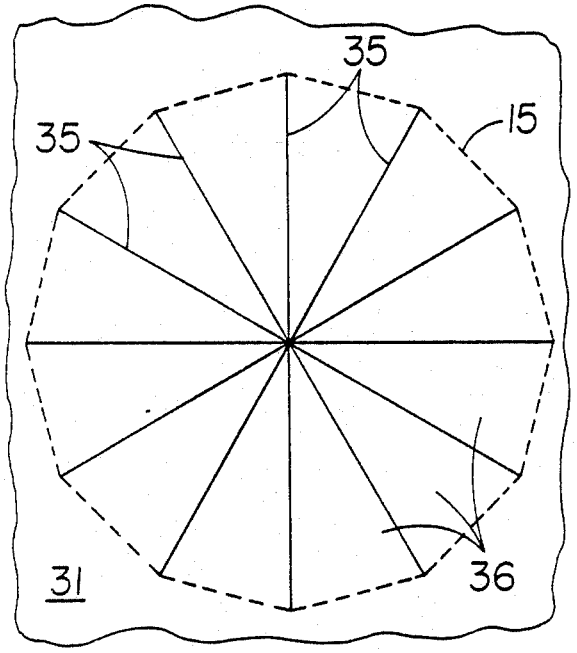
FIG. 9A is a top view illustrating the preferred embodiment of the fingers formed by slits in the base member.
Figure 9B:
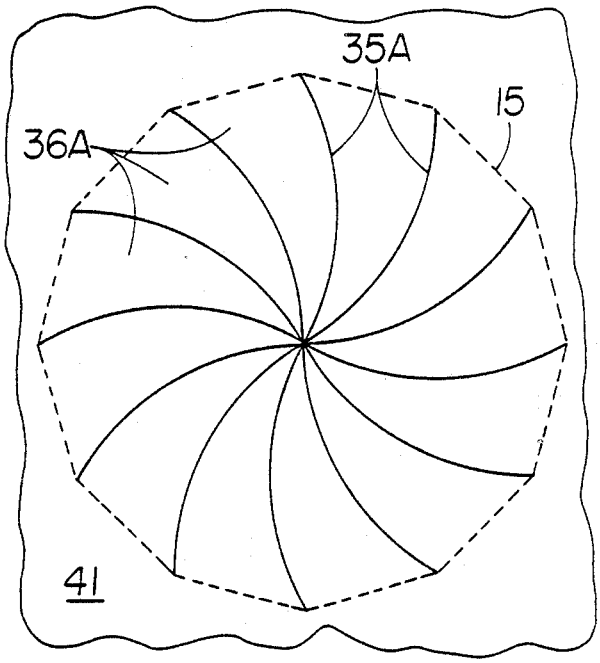
FIG. 9B is a top view of an alternate embodiment of the fingers formed by slits in the base member.
Figure 9C:
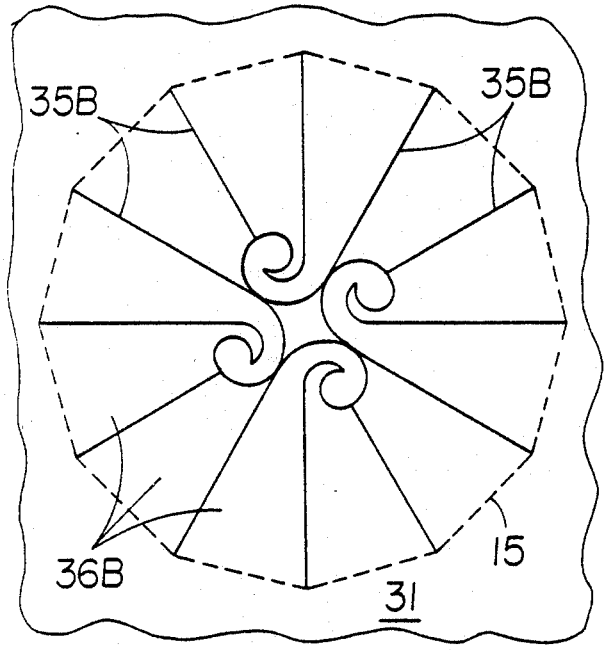
FIG. 9C is a top view of a further alternate embodiment of the fingers formed by slits in the base member.
Figure 9D:
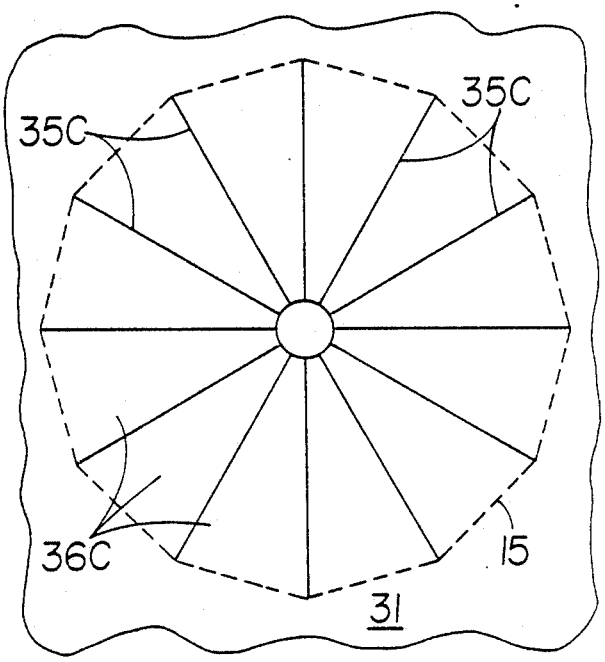
FIG. 9D is a top view of yet another alternate embodiment of the fingers formed by slits in the base member.

FIGS. 9A, 9B, 9C, and FIG. 9D illustrate various designs of the gripping fingers defined or formed by the cuts or slits in base member 12 or 13. FIG. 9A illustrates a spoke design, as illustrated in FIGS. 1–3, wherein cuts or slits are made in the floor 31 of base member 12 along cut lines 35 to form substantially triangular or pie-shaped fingers 36. FIG. 9B illustrates a pinwheel design wherein cuts or slits are made in the floor 41 of base member 13 along cut lines 35A to form fingers 36A, as illustrated in FIGS. 4–8. The pointed tips of fingers 36 or 36A facilitate gripping of the painter's wrist. FIG. 9C illustrates a design wherein cuts or slits are made in the floor 31 of base member 12 along cut lines 35B to form a plurality of fingers 36B, including a plurality of substantially J-shaped fingers. FIG. 9D illustrates a design wherein cuts or slits are made in the floor 31 of base member 12 along cut lines 35C to form a plurality of fingers 36C.

It is to be understood that fingers 36, 36A, 36B, or 36C may be cut in either base member 12 or 13. Further, in the finger embodiments shown in FIG. 9A and FIG. 9B, no portion of base member material is removed from base members 12 or 13. However, in the finger embodiments shown in FIG. 9C and FIG. 9D, a small portion of base member material is removed from approximately the center of floor 31 or 41 during the cutting thereof.

The preferred method for constructing a paint drip pan 10 comprises the steps of cutting slits in a base member 12, such as a styrofoam food tray, so as to form an aperture 14 sized and shaped to receive a painter's hand and wrist and a plurality of resilient gripping fingers, such as fingers 36, 36A, 38B, or 36C, integral with base member 12 about aperture 14. A glove member 38 may thereafter be inserted through the resulting aperture 14 and secured to the base member 12, such as by gluing the lowermost edge 40 of glove member 38 to the underside of base member 12. The method for constructing a paint drip pan 11 comprises the steps of constructing a base member 13 in the shape as described hereinabove and cutting a plurality of slits in base member 13 to form an aperture 14 sized and shaped to receive a painter's hand and wrist and a plurality of resilient gripping fingers, such as fingers 36, 36A, 36B, or 36C, integral with base member 13 about aperture 14. A glove member 38 may thereafter be inserted through the resulting aperture 14 and secured to the base member 13, such as by gluing the lowermost edge 40 of glove member 38 to the underside of base member 13. One or more guide loops 42 may also be glued or otherwise secured to the underside of base member 12 or 13. In the event glove member 38 is not secured to base member 12 or 13, the glove member 38 may be placed over the hand before thrusting the hand through aperture 14, with fingers 36, 36A, 36B, or 36C, thereafter holding the glove member 38 in place.

In an alternate mode of usage of the present invention, the paint drip pan 10 or 11 is turned upside down and the handle of the paint brush or roller (not shown) is inserted through aperture 14 into glove member 38. In this mode, fingers 36, 36A, 36B, or 36C impinge against the glove member 38 and grip the brush or roller handle. The outside of glove member 38 may thereafter be grasped by the painter, thereby grasping the handle of the paint brush o roller within the glove member 38, with the glove member 38 protecting the painter's hands from contacting the brush or roller handle. In this mode of usage, the underside of the base member 12 or 13 will catch paint drips or splatters. The present invention thus allows for two alternate modes of usage, one mode allowing the brush or roller handle to be gripped above the base member 12 or 13 and the other mode allowing the brush or roller handle to be gripped below the base member 12 or 13.

It is to be understood that the glove member 38 is adaptable to the left o right hand and is preferably oriented substantially transverse to the substantially planar base member 12 or 13. It is also to be understood that the glove member 38 need not be secured to base member 12 or 13. That is, the fingers 36, 36A, 36B or 36C will impinge against the glove member 38, thereby securing the base member 12 or 13 and glove member 38 to the painter's wrist. It is also to be understood that base member 12 or 13 may be utilized without glove member 38, the fingers 36, 36A, 36B or 36C thereby impinging directly against the painter's wrist. It is also to be understood that fingers 36, 36A, 36B or 36C may be reinforced and that a rubber strap or band or other type of wristlet may be superimposed about the outside of fingers 36, 36A, 36B or 36C to provide a further gripping of the painter's wrist. Also, fingers 36, 36A, 36B or 36C may be eliminated and another type of wristlet (not shown), such as a wrist band, may be connected to base member 12 or 13 and superimposed about aperture 14. It is also to be understood that fingers 36, 36A, 36B or 36C provide a self adjusting, self supporting, self leveling, self grasping paint drip apparatus which is adaptable to a wide range of wrist sizes. Base member 12 preferably has a length of approximately twelve inches (12"), a width of approximately nine inches (9"), and a depth of approximately one inch (1"). Finally, it is to be understood that the pan 10 or 11 is preferably waterproof and disposable and may also be utilized as a dust shield for cleaning or drilling overhead.

The present invention thus provides a lightweight, inexpensive paint drip apparatus which comprises an expandable wristlet which automatically adjusts to accommodate a variety of wrist sizes. Further, since the paint drip apparatus is self attaching and self supporting, the user's hands are free for work. Finally, base members 12 and 13 may also be constructed of waterproof paper and guide loops 42 may be constructed of cardboard, styrofoam, or paper.

While the paint drip pan has been described in connection with the preferred embodiment, it is not intended to limit the invention to the particular form set forth, but on the contrary, it is intended to cover such alternatives, modifications, and equivalents, as may be included within the spirit and scope of the invention, as defined by the appended claims.

I claim:

1. A paint drip pan, comprising:

a substantially planar base member having an aperture therethrough within which to receive a painter's wrist; and means for adjustably gripping said painter's wrist when said painter's wrist is within said aperture to accommodate a variety of wrist sizes and secure said base member to said painter's wrist.

2. A paint drip pan, comprising:

a base member having an aperture therethrough within which to receive a painter's wrist; and a plurality of resilient fingers integral with said base member and positioned about said aperture for impinging against said painter's wrist when said painter's wrist is within said aperture to secure said base member to said painter's wrist.

3. Paint drip catching apparatus, comprising:

a base member having an aperture therethrough within which to receive a painter's wrist;

a glove member adapted to be received within said aperture; and means for impinging against said glove member when said glove member is received within said aperture to grip said painter's wrist and secure said apparatus to said painter's wrist when said painter's wrist is within said aperture.

4. Paint drip catching apparatus, as recited in claim 3, wherein an uppermost surface of said base member comprises a plurality of ridges defining a plurality of distinct channels.

5. Paint drip catching apparatus, as recited in claim 3, wherein said means for impinging against said glove member comprises a plurality of resilient fingers integral with said base member and positioned about said aperture.

6. Paint drip catching apparatus, as recited in claim 3, wherein said base member further comprises a plurality of guide loops secured to an underside thereof for tilting said base member in a desired direction.

7. Paint drip catching apparatus, comprising:

a base member having an aperture therethrough within which to receive a painter's wrist, said base member further comprising a plurality of ridges defining distinct channels in an uppermost surface of said base member and a plurality of guide loops secured to a lowermost surface of said base member for tilting said base member in a desired direction;

a glove member within said aperture attached to said base member; and a plurality of resilient fingers integral with said base member and disposed about said aperture for securing said base member to said painter's wrist when said painter's wrist is received within said aperture.

8. Paint drip catching apparatus, as recited in claim 7, wherein each of said fingers are substantially triangular in shape.

9. Paint drip catching apparatus, as recited in claim 7, wherein a first and second edge of said base member define approximately a right angle with respect to each other, said second edge and a third edge of said base member intersect to form a substantially curved corner, said third edge and a fourth edge of said base member define approximately an obtuse angle with respect to each other, and said fourth edge and said first edge define approximately an acute angle with respect to each other.

10. A method for constructing paint drip catching apparatus comprising the steps of:

(a) cutting a plurality of slits in a base member to form an aperture in said base member and a plurality of gripping fingers; and (b) inserting a glove member through said aperture.

11. A method for constructing a paint drip catching apparatus, as recited in claim 10, further comprising the step of securing said glove member to said base member.

12. A method for constructing a paint drip catching apparatus, as recited in claim 10, further comprising the step of securing a guide loop to an underside of said base member.

* * * * *